US005806342A

United States Patent [19]

Bonaquist et al.

[11] Patent Number: 5,806,342

[45] Date of Patent: Sep. 15, 1998

[54] CRYOGENIC RECTIFICATION SYSTEM FOR PRODUCING LOW PURITY OXYGEN AND HIGH PURITY OXYGEN

[75] Inventors: Dante Patrick Bonaquist, Grand Island; Nancy Jean Lynch, North Tonawanda; Susan Marie Sattan, Amherst; James Richard Handley, East Amherst, all of N.Y.

[73] Assignee: Praxair Technology, Inc., Danbury, Conn.

[21] Appl. No.: 950,744

[22] Filed: Oct. 15, 1997

[51] Int. Cl.[6] ..... F25J 3/02

[52] U.S. Cl. ..... 62/646; 62/651

[58] Field of Search ..... 62/651, 646

[56] References Cited

U.S. PATENT DOCUMENTS

| | | | |
|---|---|---|---|
| 4,224,045 | 9/1980 | Olszewski et al. | 62/30 |
| 5,123,946 | 6/1992 | Ha | 62/651 |
| 5,165,244 | 11/1992 | Kleinberg et al. | 62/24 |
| 5,315,833 | 5/1994 | Ha et al. | 62/38 |
| 5,392,609 | 2/1995 | Girault et al. | 62/25 |
| 5,442,925 | 8/1995 | Agrawal et al. | 62/651 |
| 5,546,767 | 8/1996 | Dray et al. | 62/646 |
| 5,611,219 | 3/1997 | Bonaquist | 62/646 |
| 5,628,207 | 5/1997 | Howard et al. | 62/646 |
| 5,651,271 | 7/1997 | Fraysse et al. | 62/651 |
| 5,669,236 | 9/1997 | Billingham et al. | 62/643 |

*Primary Examiner*—Ronald C. Capossela
*Attorney, Agent, or Firm*—Stanley Ktorides

[57] ABSTRACT

A cryogenic rectification system for producing low purity oxygen and high purity oxygen employing an offset dual column with bottom reboil of the lower pressure column effected by condensing feed air, with intermediate reboil of the lower pressure column effected by condensing higher pressure column top vapor, and with waste nitrogen turboexpansion to generate refrigeration.

7 Claims, 3 Drawing Sheets

CRYOGENIC RECTIFICATION SYSTEM FOR PRODUCING LOW PURITY OXYGEN AND HIGH PURITY OXYGEN

TECHNICAL FIELD

This invention relates generally to the cryogenic rectification of feed air and, more particularly, to the cryogenic rectification of feed air to produce oxygen.

BACKGROUND ART

The demand for low purity oxygen is increasing in applications such as glassmaking, steelmaking and energy production. Low purity oxygen is generally produced in large quantities by the cryogenic rectification of feed air in a double column wherein the low purity oxygen is recovered at the low pressure of the lower pressure column.

Some users of low purity oxygen, for example integrated steel mills, often require some high purity oxygen in addition to lower purity gaseous oxygen. Such dual purity production cannot be efficiently accomplished with a conventional lower purity oxygen plant.

Moreover, it is increasingly desirable to produce both of these products at a higher pressure than that of the conventional lower pressure column of a double column plant. While such higher pressure may be achieved using additional equipment such as pumps or compressors, such additional equipment imposes a higher cost, and thus it is desirable to recover such products at elevated pressure directly from the column.

Accordingly, it is an object of this invention to provide a cryogenic rectification system which can effectively and efficiently produce both low purity oxygen and high purity oxygen, particularly at elevated pressure.

SUMMARY OF THE INVENTION

The above and other objects, which will become apparent to one skilled in the art upon reading of this disclosure, are attained by the present invention, one aspect of which is:

A cryogenic rectification method for producing low purity oxygen and high purity oxygen comprising:

(A) condensing feed air by indirect heat exchange with bottom liquid from a lower pressure column and passing feed air into a higher pressure column;

(B) separating feed air by cryogenic rectification within the higher pressure column to produce nitrogen-enriched vapor and oxygen-enriched liquid;

(C) condensing nitrogen-enriched vapor by indirect heat exchange with intermediate liquid from the lower pressure column to produce nitrogen-enriched liquid, and passing nitrogen-enriched liquid and oxygen-enriched liquid into the lower pressure column;

(D) producing low purity oxygen and high purity oxygen by cryogenic rectification within the lower pressure column;

(E) withdrawing low purity oxygen fluid from the lower pressure column at a level below that from which said intermediate liquid is taken, and recovering said lower purity oxygen fluid as product; and (F) withdrawing high purity oxygen fluid from the lower pressure column at a level below that from which said low purity oxygen fluid is taken, and recovering said high purity oxygen as product.

Another aspect of the invention is:

Cryogenic rectification apparatus for producing low purity oxygen and high purity oxygen comprising:

(A) a first column having a bottom reboiler and an intermediate reboiler;

(B) a second column and means for passing feed air to the bottom reboiler and from the bottom reboiler into the second column;

(C) means for passing fluid from the upper portion of the second column to the intermediate reboiler and from the intermediate reboiler into the first column;

(D) means for passing fluid from lower portion of the second column into the first column;

(E) means for recovering low purity oxygen communicating with the first column at a level below that of the intermediate reboiler; and (F) means for recovering high purity oxygen communicating with the first column at a level below that where the means for recovering low purity oxygen communicates with the first column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein the term "feed air" means a mixture comprising primarily oxygen and nitrogen, such as ambient air.

As used herein the term "low purity oxygen" means a fluid having an oxygen concentration within the range of from 50 to 98.5 mole percent.

As used herein, the term "high purity oxygen" means a fluid having an oxygen concentration greater than 98.5 mole percent.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein the term "reboiler" means a heat exchange device that generates column upflow vapor from column liquid.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "bottom" when referring to a column means that section of the column below the column mass transfer internals, i.e. trays or packing.

As used herein, the term "bottom reboiler" means a reboiler that boils liquid from the bottom of a column.

As used herein, the term "intermediate reboiler" means a reboiler that boils intermediate liquid, i.e. liquid from above the bottom of a column. The level of the intermediate reboiler is the level from which such intermediate liquid is taken.

The numerals in the Figures are the same for the common elements.

DETAILED DESCRIPTION

The invention will be described in detail with reference to the Drawings.

Figure 1:
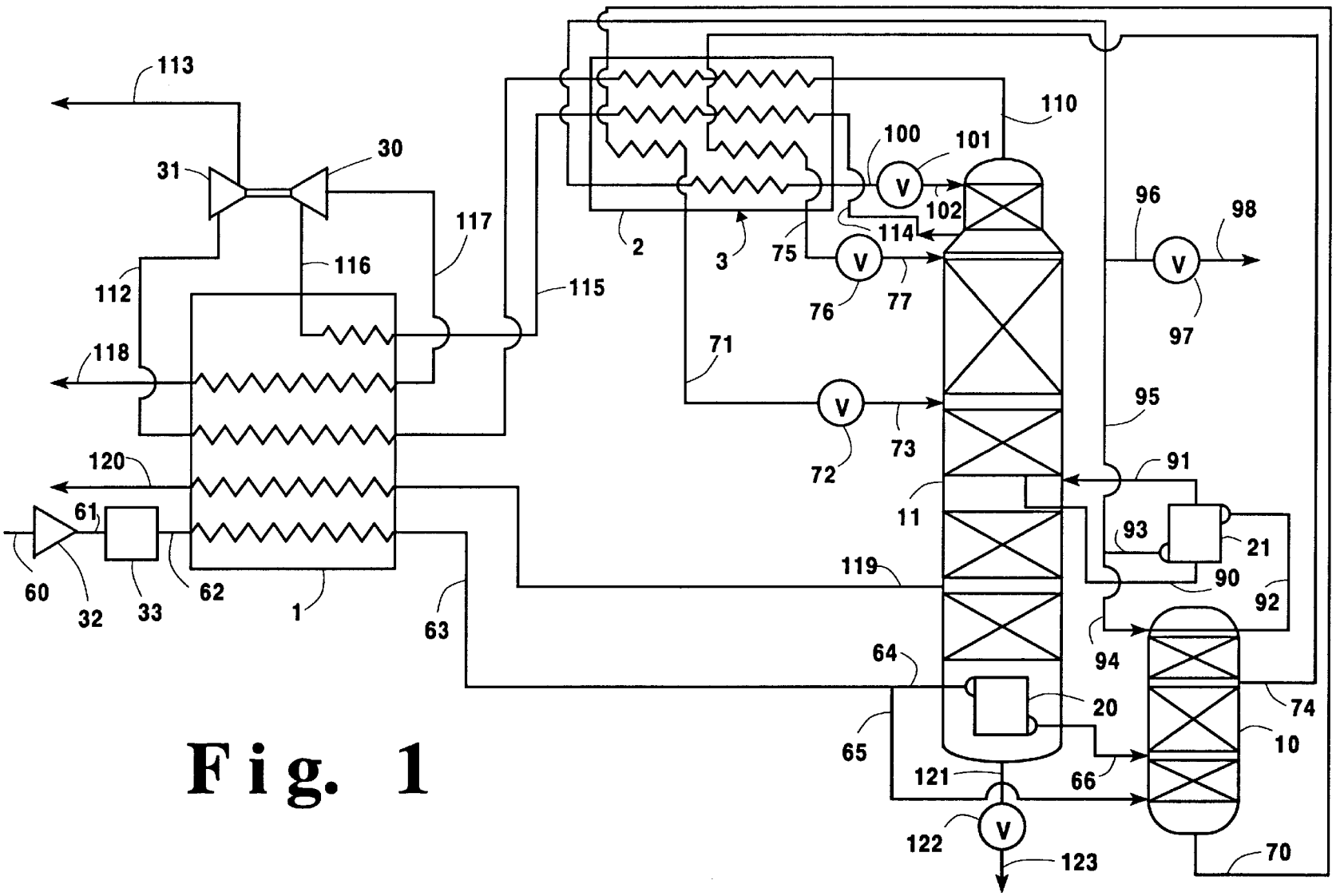
FIG. 1 is a schematic representation of one preferred embodiment of the invention wherein product nitrogen is also recovered.

Referring now to FIG. 1, feed air 60 is compressed by passage through compressor 32 to a pressure generally within the range of from 80 to 150 pounds per square inch absolute (psia). Resulting pressurized feed air 61 is cleaned of high boiling impurities such as carbon dioxide and water vapor by passage through prepurifier 33, and then passed as stream 62 through primary heat exchange 1 wherein it is cooled by indirect heat exchange against return streams. About 25 to 30 percent of the cleaned, cooled, compressed feed air 63 exiting primary heat exchanger 1 is passed as stream 64 into bottom reboiler 20 of first or lower pressure column 11 which also has an intermediate reboiler 21. Feed air 64 is condensed in bottom reboiler 20 by indirect heat exchange with column 11 bottom liquid, and the resulting condensed feed air stream 66 is passed into second or higher pressure column 10 at a level within the range of from 3 to 10 equilibrium stages above the bottom of column 10. About 70 to 75 percent of the cleaned, cooled, compressed feed air 63 exiting primary heat exchanger 1 is passed as stream 65 into higher pressure column 10, preferably at a level below where stream 66 is passed into the column and most preferably at the bottom of the column.

Second or higher pressure column 10 is operating at a pressure generally within the range of from 75 to 145 psia. Within higher pressure column 10 the feed air is separated by cryogenic rectification into nitrogen-enriched vapor and oxygen-enriched liquid. Oxygen-enriched liquid is withdrawn from the lower portion of higher pressure column 10 as stream 70 and subcooled by passage through heat exchanger 2. Resulting subcooled stream 71 is passed through valve 72 and, as stream 73, into first or lower pressure column 11. A nitrogen-containing liquid stream 74 is withdrawn from below the top of higher pressure column 10 and subcooled by passage through heat exchanger 3. Resulting subcooled stream 75 is passed through valve 76 and, as stream 77, into lower pressure column 11.

Nitrogen-enriched vapor is withdrawn from the upper portion of higher pressure column 10 as stream 92 and passed to intermediate reboiler 21 wherein it is condensed by indirect heat exchange with intermediate liquid 90 which is taken from lower pressure column 11 at a level from 20 to 40 equilibrium stages above the bottom of column 11, i.e. above bottom reboiler 20. Resulting intermediate fluid 91 is passed back into column 11. A first portion 94 of the nitrogen-enriched liquid 93 from intermediate heat exchanger 21 is passed into the upper portion of column 10 as reflux. A second portion 95 of nitrogen-enriched liquid 93 is subcooled by passage through heat exchanger 3, withdrawn as subcooled stream 100, and passed through valve 100 and, as stream 102, into the upper portion of lower pressure column 11 as reflux. If desired, a third portion 96 of the nitrogen-enriched liquid from intermediate heat exchanger 21 may be passed through valve 97 and recovered as product liquid nitrogen 98 having a nitrogen concentration generally of at least 99.9 mole percent.

First or lower pressure column 11 is operating at a pressure less than that of higher pressure column 10 and generally at an elevated pressure within the range of from 20 to 50 psia. Within lower pressure column 11 the various feeds are separated by cryogenic rectification into low purity oxygen and high purity oxygen, as well as into nitrogen-rich fluid. Low purity oxygen fluid is withdrawn as vapor stream 119 from lower pressure column 11 at a level from 5 to 15 equilibrium stages below the level from which intermediate liquid 90 is taken. Preferably stream 119 is withdrawn from column 11 at a level from 5 to 25 equilibrium stages above the bottom of column 11. Vapor stream 119 is warmed by passage through primary heat exchanger 1 and recovered as low purity oxygen product 120 typically at an elevated pressure within the range of from 20 to 50 psia. The elevated pressure of the low purity oxygen product is attained without need for pumping or compressing the low purity oxygen fluid after it is withdrawn from the lower pressure column. High purity oxygen fluid is withdrawn from lower pressure column 11 as liquid stream 121 at a level from 15 to 25 equilibrium stages below the level from which stream 119 is withdrawn from column 11, and preferably at the bottom of column 11. Stream 121 is passed through valve 122 and recovered as product high purity oxygen 123.

The dual offset column system of this invention can operate effectively at elevated pressure, and thus produce elevated pressure product directly, by the turboexpansion of a waste nitrogen stream. Referring back to FIG. 1, waste nitrogen stream 114 is withdrawn from the upper portion of column 11 and warmed by passage through heat exchangers 3 and 2. Resulting stream 115 is further warmed by partial traverse of primary heat exchanger 1 and then passed as stream 116 to turboexpander 30 wherein it is turboexpanded to generate refrigeration. Resulting turboexpanded waste nitrogen stream 117 is warmed by passage through primary heat exchanger 1, wherein it serves to cool the incoming feed air, and is then removed from the system as stream 118.

The embodiment of the invention illustrated in FIG. 1 can also produce nitrogen product. In this embodiment nitrogen-rich vapor is withdrawn as stream 110 from the upper portion of column 11 at a level from 5 to 15 equilibrium stages above the level from which stream 114 is withdrawn. Stream 110 is warmed by passage through heat exchangers 3, 2 and 1 and may be recovered as product nitrogen having a nitrogen concentration of at least 99.9 mole percent. In the embodiment illustrated in FIG. 1, the nitrogen product is recovered at a high pressure. In this embodiment warmed nitrogen product stream 112 from primary heat exchanger 1 is passed to compressor 31 wherein it is compressed to a pressure generally within the range of from 50 to 400 psia, and from which it is recovered as nitrogen product stream 113. FIG. 1 illustrates a particularly preferred embodiment of the invention wherein waste nitrogen turboexpander 30 is directly coupled to and directly drives nitrogen product compressor 30. Alternatively waste nitrogen turboexpander 30 may be directly coupled to and directly drive feed air compressor 32.

Figure 2:
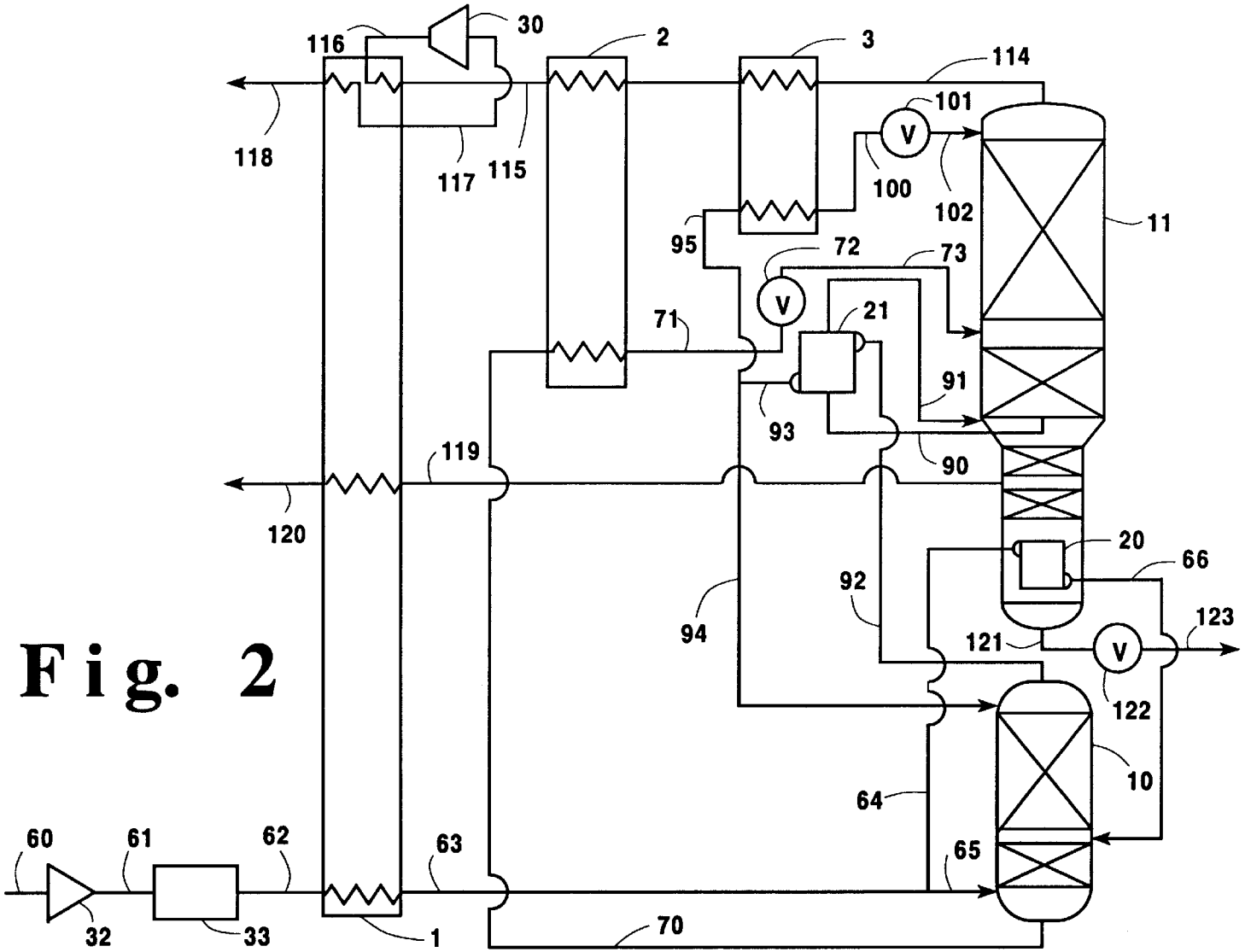
FIG. 2 is a schematic representation of another preferred embodiment of the invention.

FIG. 2 illustrates another embodiment of the invention wherein product nitrogen is not recovered.

The elements of the embodiment illustrated in FIG. 2 which are common with those of the embodiment illustrated in FIG. 1 will not be discussed again in detail. Referring now to FIG. 2, waste nitrogen stream 114 is withdrawn from the top of column 11 and is warmed and turboexpanded as described with the embodiment illustrated in FIG. 1. However, in the embodiment illustrated in FIG. 2, turboexpanded waste nitrogen 117 is returned to primary heat exchanger 1 at the point where turboexpander feed 116 was removed, rather than at the cold end of the primary heat exchanger. This allows for better use of the heat transfer surface in primary heat exchanger 1 and decreases the cross-sectional area of the required core.

Figure 3:
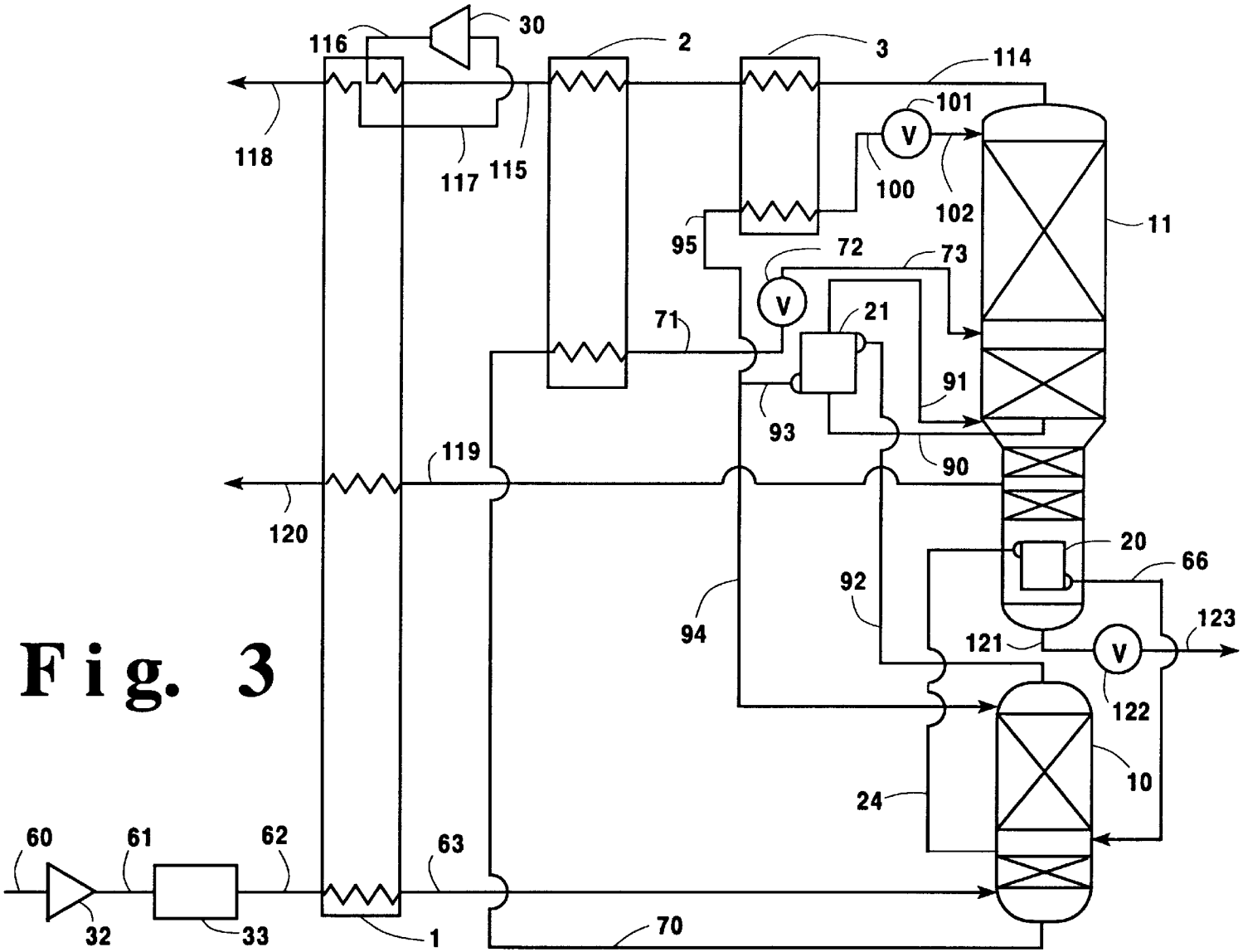
FIG. 3 is a schematic representation of another preferred embodiment of the invention.

FIG. 3 illustrates an embodiment of the invention identical with that illustrated in FIG. 2 except that the feed air stream passed into bottom reboiler 20 is taken from column 10. Feed air stream 24 is withdrawn from the lower portion of column 10 at a level from 1 to 5 equilibrium stages above the feed air stream 63 input level and passed to bottom reboiler 20 and further processed as previously described. Feed air stream 24 has a nitrogen concentration generally within the range of from 82 to 92 mole percent with the remainder being mostly oxygen. The embodiment illustrated in FIG. 3 enables a tighter, more uniform pinch in bottom reboiler 20 which makes the process more reversible and hence more efficient.

Although the invention has been described in detail with reference to certain preferred embodiments, those skilled in the art will recognize that there are other embodiments of the invention within the spirit and the scope of the claims.

We claim:

1. A cryogenic rectification method for producing low purity oxygen and high purity oxygen comprising:

(A) condensing feed air by indirect heat exchange with bottom liquid from a lower pressure column and passing feed air into a higher pressure column;

(B) separating feed air by cryogenic rectification within the higher pressure column to produce nitrogen-enriched vapor and oxygen-enriched liquid;

(C) condensing nitrogen-enriched vapor by indirect heat exchange with intermediate liquid from the lower pressure column to produce nitrogen-enriched liquid, and passing nitrogen-enriched liquid and oxygen-enriched liquid into the lower pressure column;

(D) producing low purity oxygen and high purity oxygen by cryogenic rectification within the lower pressure column;

(E) withdrawing low purity oxygen fluid from the lower pressure column at a level below that from which said intermediate liquid is taken, and recovering said lower purity oxygen fluid as product; and (F) withdrawing high purity oxygen fluid from the lower pressure column at a level below that from which said low purity oxygen fluid is taken, and recovering said high purity oxygen as product.

2. The method of claim 1 further comprising turboexpanding a nitrogen-containing stream taken from the upper portion of the lower pressure column and warming the nitrogen-containing stream by indirect heat exchange with feed air.

3. The method of claim 1 further comprising recovering a product nitrogen stream withdrawn from the upper portion of the lower pressure column.

4. Cryogenic rectification apparatus for producing low purity oxygen and high purity oxygen comprising:

(A) a first column having a bottom reboiler and an intermediate reboiler;

(B) a second column and means for passing feed air to the bottom reboiler and from the bottom reboiler into the second column;

(C) means for passing fluid from the upper portion of the second column to the intermediate reboiler and from the intermediate reboiler into the first column;

(D) means for passing fluid from lower portion of the second column into the first column;

(E) means for recovering low purity oxygen communicating with the first column at a level below that of the intermediate reboiler; and (F) means for recovering high purity oxygen communicating with the first column at a level below that where the means for recovering low purity oxygen communicates with the first column.

5. The apparatus of claim 4 further comprising a turboexpander and means for passing fluid from the upper portion of the first column to the turboexpander.

6. The apparatus of claim 4 further comprising a compressor and means for passing fluid from the upper portion of the first column to the compressor.

7. The apparatus of claim 4 further comprising a turboexpander, means for passing fluid from the upper portion of the first column to the turboexpander, a compressor, and means for passing fluid from the upper portion of the first column to the compressor, wherein said turboexpander and said compressor are directly coupled.

* * * * *